United States Patent [19]

Lyons et al.

[11] Patent Number: 5,028,518

[45] Date of Patent: Jul. 2, 1991

[54] RADIOGRAPHIC THERMOGRAPHIC IMAGING FILM

[75] Inventors: Thomas D. Lyons; Sergio Pesce; John M. Winslow, all of St. Paul, Minn.

[73] Assignee: Minnesota Mining and Manufacturing Company, St. Paul, Minn.

[21] Appl. No.: 586,878

[22] Filed: Sep. 24, 1990

[51] Int. Cl.[5] ..... G03C 1/46; G03C 1/78

[52] U.S. Cl. ..... 430/506; 430/502; 430/507; 430/508; 430/617; 430/619; 378/181; 378/185

[58] Field of Search ..... 430/139, 506, 502, 507, 430/508, 617, 619, 965, 966; 378/181, 185

[56] References Cited

U.S. PATENT DOCUMENTS

| | | | |
|---|---|---|---|
| 4,264,725 | 4/1981 | Reeves | 430/619 |
| 4,425,426 | 1/1984 | Abbott et al. | 430/502 |
| 4,526,862 | 7/1985 | Pelc | 430/966 |
| 4,639,411 | 1/1987 | Daubendiek et al. | 430/966 |

FOREIGN PATENT DOCUMENTS

| | | | |
|---|---|---|---|
| 0219010 | 4/1987 | European Pat. Off. | 430/617 |

*Primary Examiner*—Hoa Van Le

*Attorney, Agent, or Firm*—Gary L. Griswold; Walter N. Kirn; Mark A. Litman

[57] ABSTRACT

Photothermographic emulsions sensitive to ultraviolet radiation can be coated on both sides of polymeric film which is inherently absorptive of the ultraviolet radiation, preventing crossover effects in cassette loading of the film.

16 Claims, No Drawings

RADIOGRAPHIC THERMOGRAPHIC IMAGING FILM

BACKGROUND OF THE INVENTION

1. Field of the Invention

Ultraviolet radiation sensitive photothermographic emulsions which are coated on both sides of a transparent carrier layer can be provided with good anti-crossover effects by selection of emulsion sensitivity and radiation absorption properties of the carrier layer.

2. Background of the Art

Radiographic images are traditionally formed on transparent substrates so that the images may be viewed by backside transmission lighting of the image. It is particularly advantageous to generate radiographic images within a cassette having X-ray intensifying (conversion) screens on each major interior surface of the cassette. Radiation sensitive film having a separate emulsion on each side of a transparent carrier film is used within the cassette. Each emulsion is sensitive to the emission wavelengths of the adjacent intensifying screen, with both screens usually emitting at or about the same wavelengths.

These systems are quite useful, but a significant problem is encountered in the use of the two-side coated film. Light from one screen that is not absorbed or attenuated by the adjacent emulsion will pass through the carrier layer possibly forming a latent image on the opposite emulsion layer. This image is referred to in the art as crossover. The problem with this image formed by crossover is that it is farther away from the emitting screen. As the emitted radiation is not moving exclusively perpendicular from the surface of the screen, the latent image formed by crossover radiation is of much lower resolution than the image formed in the adjacent emulsion layer.

In all imaging environments where two side coated imaging systems are used in cassettes, and especially in medical imaging and even more particularly in industrial radiographic imaging, this loss of resolution is undesirable. The traditional means of reducing crossover is to add dyes into or onto the transparent carrier layer, the dye absorbing the visible radiation emitted by the intensifying/converting screens. Such systems are shown in U.S. Pat. Nos. 4,803,150, 4,478,933, 4,425,426 and 4,500,631. EPO application Ser. No. 0 350 883 A2, published Jan. 17, 1990, disclosed the use of two screens with different emitting wavelengths and two emulsions, each emulsion being spectrally sensitive to only one of the emitting screens in order to reduce crossover.

SUMMARY OF THE INVENTION

Duplitized photosensitive elements are imageable materials comprising a transparent base with at least one separate imageable layer on each side of the transparent base. Typically duplitized elements comprise a transparent polymeric film base having one photosensitive imaging layer on each major surface of the base. The imaging layers are usually photographic silver halide layers, photothermographic (e.g., dry silver) imaging layers, diazonium photosensitive thermally developable layers (e.g., diazo coupling layers, dye bleach layers, and leuco dye oxidation layers), photopolymerizable layers, and the like.

The use of photosensitive layers having their highest levels of spectral sensitivity below 350 nm in duplitized film has been found to have reduced crossover imaging where polyethyleneterephthalate is used as the transparent carrier layer. This polyester film displays strong absorption of ultraviolet radiation (0.3 optical density at 350 nm, 3 mil (0.076 mm) thickness; 1.0 optical density at 313 nm, 3 mil (0.076 mm) thickness; 2.3 optical density at 310 nm, 0.076 mm thickness; and 3.0 optical density or higher between 200 and 300 nm at a film thickness of 0.076 mm). Preferred strong sensitivity of the emulsion is between 250 and 340 nm.

The kinds of photosensitive system which would benefit most from the practice of this invention are those systems which have their highest sensitivity at 350 nm down to 200 nm. A system using silver halide photothermographic emulsions on both sides of a polyester support would be particularly advantageous. Certain emulsions do not exhibit a clearly defined peak sensitivity, but display a range of strong sensitivity that effectively covers a 25–100 nm range of wavelengths in the ultraviolet region.

Silver halide photothermographic imaging materials, often referred to as "dry silver" compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No. 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and U.S. Pat. No. 4,260,677 discloses the use of complexes of inorganic or organic silver salts as image source materials.

In both photographic and photothermographic emulsions, exposure of the silver halide to light produces small clusters of silver atoms. The imagewise distribution of these clusters is known in the art as the latent image. This latent image generally is not visible by ordinary means and the light sensitive article must be further processed in order to produce a visual image. The visual image is produced by the catalytic reduction of silver ions which are in catalytic proximity to the specks of the latent image.

Typically, photothermographic chemistry is prepared in a single composition with binder, and are formed in any manner which does not developmentally sensitize the silver halide in the chemistry.

Conventional silver halide photothermographic chemistry is used as the photothermographic chemistry in the system of the present invention. Such chemistry is well described in U.S. Pat. Nos. 3,457,075; 3,839,049; 3,985,565; 4,022,617 and 4,460,681. These can be either black-and-white or color chemistries. Either in situ halidization (e.g., U.S. Pat. No. 3,457,075) or preformed silver halide sources (e.g., U.S. Pat. No. 3,839,049) may be used. Any of the various photothermographic media, such as full soaps, partial soaps, full salts, and the like may be used in the photothermographic chemistry contained in the particles.

Conventional photothermographic chemistry comprises a photosensitive silver halide catalyst, a silver compound capable of being reduced to form a metallic silver image (e.g., silver salts, both organic and inorganic, and silver complexes, usually light insensitive silver materials), a developing agent for silver ion (a mild reducing agent for silver ion), and a binder. Color photothermographic systems additionally have a leuco dye or dye forming developer (alone or in combination with a developer for silver ion), or a color photographic coupler which would require a color photographic developer to be used as the developing agent for silver ion. Thus both negative and positive systems can be used.

The leuco dyes and dye forming developers used in the present invention may be any colorless or lightly colored (i.e., Dmax of less than 0.2 in a concentration of 5% by weight in a 20 micron thick transparent binder layer) compound which forms a visible dye upon oxidation. The compound must be oxidizable to a colored state. Compounds which are both pH sensitive and oxidizable to a colored state are useful but not preferred, while compounds only sensitive to changes in pH are not included within the term "leuco dyes" since they are not oxidizable to a colored form.

The dyes formed from the leuco dyes in the various color-forming particles should of course be different. A difference of at least 60 nm in reflective or transmissive maximum absorbance is required. Preferably the absorbance maximum of dyes formed will differ at least 80 or 100 nm. When three dyes are to be formed, two should differ by at least these minimums, and the third should differ from at least one of the other dyes by at least 150 nm and preferably at least 200 or even at least 250 nm. This will provide a good, full color range for the final image.

Any leuco dye capable of being oxidized by silver ion to form a visible dye is useful in color forming systems of the present invention as previously noted. Dye forming developers such as those disclosed in U.S. Pat. Nos. 3,445,234; 4,021,250; 4,022,617 and 4,368,247 are useful. In particular, the dyes listed in Japanese Kohyo National Publication No. 500352/82, published Feb.25, 1982 are preferred. Naphthols and arylmethyl-1-naphthols are generally preferred.

Conventional photothermographic chemistry is usually constructed as one or two layers on a substrate. Single layer constructions must contain the silver source material, the silver halide, the developer and binder as well as optional additional materials such as toners, coating aids and other adjuvants. Two-layer constructions must contain silver source and silver halide in one emulsion layer (usually the layer adjacent substrate) and the other ingredients in the second layer or both layers. In the present invention it is preferred to use single layer chemistry.

The silver source materials, as mentioned above, ordinarily may be any material which contains a reducible source of silver ions. Silver salts of organic acids, particularly long chain (10 to 30, preferably 15 to 28 carbon atoms) fatty carboxylic acids are preferred in the practice of the present invention. Complexes of organic or inorganic silver salts wherein the ligand has a gross stability constant between 4.0 and 10.0 are also useful in the present invention. The silver source material should constitute from about 20 to 70 percent by weight of the imaging layer. Preferably it is present as 30 to 55 percent by weight.

The silver halide may be any photosensitive silver halide such as silver bromide, silver iodide, silver chloride, silver bromoiodide, silver chlorobromoiodide, silver chlorobromide, etc., and may be added to the layer in any fashion which places it in catalytic proximity to the silver source. The silver halide is generally present as 0.75 to 15 percent by weight of the particle, although larger amounts are useful. It is preferred to use from 1 to 10 percent by weight silver halide in the layer and most preferred to use from 1.5 to 7.0 percent.

The silver halide may be provided by in situ halidization or by the use of pre-formed silver halide. The use of sensitizing dyes for the silver halide is particularly desirable. These dyes can be used to match the spectral response of the emulsions to the spectral emissions of intensifier screens. It is particularly useful to use J-banding dyes to sensitive the emulsion as disclosed in U.S. Pat. No. 4,476,220.

The reducing agent for silver ion may be any material, preferably organic material, which will reduce silver ion to metallic silver. Conventional photographic developers such as phenidone, hydroquinones, and catechol are useful, but hindered phenol reducing agents are preferred. The reducing agent should be present as 1 to 20 percent by weight of the imaging particle. In a two-layer construction, if the reducing agent is in the second layer, slightly higher proportions, of from about 2 to 20 percent tend to be more desirable.

Toners such as phthalazinone, phthalazine and phthalic acid are not essential to the construction, but are highly desirable. These materials may be present, for example, in amounts of from 0.2 to 5 percent by weight.

The binder may be selected from any of the well known natural and synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are, of course, included in these definitions. The polyvinyl acetals, such as polyvinyl butyral and polyvinyl formal and vinyl copolymers, such as polyvinyl acetate/chloride are particularly desirable. The binders are generally used in a range of from 20 to 75 percent by weight of the silver containing layer, and preferably about 30 to 55 percent by weight.

As previously noted, various other adjuvants may be added to the photothermographic layer of the present invention. For example, toners, accelerators, acutance dyes, sensitizers, stabilizers, surfactants, lubricants, coating aids, antifoggants, leuco dyes, chelating agents, binder crosslinking agents, and various other well-known additives may be usefully incorporated in the layers. The use of acutance dyes matched to the spectral emission of an intensifying screen is particularly desirable.

The film base must be a transparent synthetic organic polymeric film which (when free of dyes, pigments, and ultraviolet radiation absorbing additives dissolved in the polymer, excluding residual monomer) absorbs at an optical density of at least 0.3 at a wavelength between 200 and 350 nm corresponding to the peak or a range of strong or significant spectral sensitivity of at least one emulsion coated thereon. Preferably both emulsions have their peak spectral sensitivities at wavelengths within 20 nm of each other, and more preferably within 10 or 5 nm of each other.

The polyester base must be at least 0.03 mm thick, preferably at least 0.05 mm thick and generally between 0.05 and 1.0 mm thick.

Amongst the many known phosphors which emit in the ultraviolet region of the electromagnetic spectrum when struck by X-rays are $(Y,Gd)PO_4$, $Y_2O_3$:Gd, $YTaO_4$:Tm, $YNb_{0.05}T_{0.95}O_4$, $(Y,In)PO_4$, $HfP_2O_7$, $Ca_2ZrSi_4O_{12}$:Pb, and $BaZnSiO_2$:Pb.

A particularly good screen can be made with Yttrium Oxide:Gaddinium Phosphor manufactured by GTE Products, Towanda, Pennsylvania. The phosphor emits at 315 nm and has an average particle size of 5.0 micrometers. The phosphor can be coated out at a weight of 450 g/m$^2$ on polyester to provide a good screen.

EXAMPLE 1

A silver behenate dispersion was first prepared by homogenizing 150 g of a silver behenate half soap (converted to 14% silver by weight) and 850 g acetone. A photothermographic emulsion was prepared by using 150 g of the dispersion with the following ingredients, each added in its listed order with mixing:

6.0 g toluene
0.0 g acetone
0.30 g poly(vinylbutyral) B-76
2.0 ml of ZnBr solution (10 g ZnBr per 100 ml of methanol The mixture was held for 4 hours. To this was added:

28.8 g poly(vinylbutyral) B-76 and
7.5 g 1,1-bis (1-hydroxy-3-tert-butyl-2-phenyl)hexane (antifoggant)

The resulting composition was first coated on 0.076 mm transparent polyethyleneterephthalate polyester by means of a knife coater. A dry coating weight of 11 g/m$^2$ was applied.

An active, protective top coat solution was prepared with the following ingredients:

55.7 g acetone
17.5 g methyl ethyl ketone
11.1 g toluene
4.5 g cellulose acetate
0.51 g phthalazine
0.36 g 4-methyl phthalic acid
0.21 g tetrachlorophthalic acid
0.17 g phthalic anhydride The solution was coated at 0.2 g/ft$^2$ (2.15 g/m$^2$) over the first coating. Each layer was dried at 180° F. (80° C.) for three minutes. Identical coatings were then provided on the other side of the polyester base. After exposure to X-rays, the material was processed at 255° F. (118° C.) for six seconds. The image obtained was evaluated by a densitometer.

Exposure was accomplished after inserting the film into a cassette having two interior ultraviolet radiation emitting conversion screens on the interior faces of the cassette. The screens used yttrium oxide, gadolinium activated UV-emitting phosphors.

EXAMPLE 2

Film and Screen Preparation

(A) Dry Silver Film

The technique of preformed silver halide emulsion as described in U.S. Pat. No. 4,161,408 was used to prepare the photosensitive coatings. A specific formula for coating is presented here.

I. Preformed Silver Bromide Emulsion

The conventional double jet method for precipitation of silver bromide was used with quadratic jet ramping. The pAg was maintained at 2.0 in 3% phthalated gelatin. Coagulation was accomplished by the addition of sulfuric acid to pH 2.5. The coagulum was washed to remove soluble salts and reconstituted by adjusting the pH to 6.8 and raising the temperature to 45° C. The resulting crystals as measured by electron microscopy, had an average edge size of 0.055 microns. This silver bromide emulsion was stored at 40° F. (5° C.) until further use.

II. Silver Soap/Preformed Silver Bromide

All operations are under a red safe light. The same soap making procedures of Example 1 were used.

III. Preparation of Dry Silver Coating

The product of (II) was homogenized as a suspension formed from

12% (II)
67% Methyl ethyl ketone
21% toluene in a high pressure homogenizer.

A coating emulsion was formed by combining:

200 gms homogenate
42 gms Butvar B76 resin (Monsanto Corp.)
40 gms methyl ethyl ketone
2 ml 10% (W/Vol) mercuric bromide in methyl alcohol
4 gms Permanax TM WSO hindered phenol developing agent.

This emulsion was coated onto each side of 0.005 inch (0.127 mm) polyester base at a coating thickness of 5.5 mils (0.140 mm) wet thickness. This coating was dried at 190° F. (87° C.) for 3 minutes. A second trip coating solution was prepared as follows:

74.64% methyl ethyl ketone
12.02% acetone
4.91% methanol
0.04% FC 431 fluorocarbon wetting agent (3M Co.)
0.59% phthalazine
0.41% 4 methylphthalic acid
0.12% tetrachlorophthalic acid
0.27% tetrachlorophthalic anhydride
7.00% cellulose acetate CA 398-6

This coating was applied to the first trip coating at a coating thickness of 2.25 mils (0.07 mm) wet thickness.

(B) Ultraviolet Emitting Phosphor Screen

An UV emitting phosphor screen was prepared consisting of the type NP-3040 (Y, Sr, Li) $TaO_4$ phosphor of Nichia Kagaku Kogyo K.K. with average particle grain size of 5.9 μm coated in a hydrophobic polymer binder at a phosphor coverage of 463 g/m$^2$ and a thickness of 110 μm on a polyester support. Between the phosphor layer and the support a reflective layer of $TiO_2$ particles in a poly(urethane) binder was coated. The screen was overcoated with a cellulose triacetate layer. The principle emission from this screen occurs at 326 nm upon irradiation with X-rays and gamma rays.

EXAMPLES OF X-RAY PERFORMANCE

Image quality in industrial radiography is measured with the use of a penetrameter. The penetrameter is a thin strip of metal with similar alloy composition to the metal part being inspected. Small holes contained in the penetrameter produce indications on the radiograph which provide a quantitative measurement of film quality. These three holes are referred to as 1T, 2T, and 4T where T is the thickness of the penetrameter and the number represents the multiplication factor. Thus the 4T hole is four times larger than the 1T hole. Further definition of industrial radiography terms may be found in "Physics of Industrial Radiology", edited by R. Halmshaw, Elsevier Press, 1966.

The commercial practice of industrial radiography is governed to a large extent by industrial and military codes. For example, the American Society of Mechanical Engineers, ASME, Boiler and Pressure Vessel code, Section 5 requires a minimum level of penetrameter sensitivity be achieved in the radiograph during the nondestructive examination of steel weldments. Thus the inspection of the quality of a steel weldment of 0.5 inch (1.27 cm) thickness requires the image of the 2T hole of the corresponding penetrameter be clearly visible in the X-ray radiograph of the weldment.

Even more restrictive in film quality is MIL-STD-00453B (USAF) which requires a clear image of the 1T hole on the radiograph in certain aircraft inspection procedures.

This invention provides radiographs with penetrameter sensitivity which meets or exceeds industrial code requirements as shown in the following examples.

EXAMPLE 3

This is an example of steel radiography. The test item was a butt weld of 0.5 inch (1.27 cm) steel. The appropriate ASME penetrameter, No. 10, was placed adjacent to the weld region on the test item. This was placed on the surface of a vinyl cassette containing an 8×10 inch (20.3 cm×25.4 cm) piece of the dry silver film of Example 2 sandwiched between two 8×10 inch (20.3 cm×25.4 cm) sections of the ultraviolet screen of Example 2.

This assembly was exposed to X-rays with the following technique:

| | |
|---|---|
| X-ray source: | T.E.D. 250 KV cabinet unit |
| X-ray potential: | 250 KVp |
| Current: | 5 milliamps |
| Exposure time: | 2 minutes |
| sfd: | 48 inches |

Following the X-ray exposure the dry silver film was developed in an automatic thermal processor, 3M M9014 with a 10 second dwell time operating at 275° F. (135° C.).

The resulting image had an optical density of 2.0 in the penetrameter area and all three holes of the penetrameter were clearly visible. This penetrameter sensitivity exceeds requirements of ASME Section 5.

EXAMPLE 4

This is an example of aluminum radiography. The specimen was an aluminum casting with varying thicknesses between 0.5 and 1.0 inches (1.27 and 2.54 cm). The casting was placed on the surface of a vinyl cassette containing the dry silver film/U.V. screens as in Example 3.

These aluminum blocks, 0.5 inch (1.27 cm), 0.75 inch (1.90 cm) and 1.0 inch (2.54 cm) thickness with the appropriate MIL-STD-453 penetrameter on each surface were placed adjacent to the casting on the cassette. This assembly was exposed to X-rays with the following technique:

| | |
|---|---|
| X-ray source: | Faxitron X-ray cabinet (Hewlett-Packard) |
| X-ray potential: | 85 KVp |
| Current: | 2.5 milliamps |
| Exposure time: | 75 seconds |
| sfd: | 28 inches (71.1 cm) |

Thermal processing of this exposed film as in Example 3 produced a radiographic image of the aluminum casting and the aluminum blocks. Densities and penetrameter sensitivities are shown in Table 1.

TABLE 1

| Aluminum Radiography | | |
|---|---|---|
| Thickness | Density | Penetrameter Sensitivity |
| 1.27 cm | 1.35 | 1T |
| 1.90 cm | 1.90 | 1T |
| 2.54 cm | 2.65 | 1T |

These data show the film/screen combination of this invention provides sufficient dynamic range and image sharpness to meet the radiographic requirements of MIL-STD-453.

What is claimed is:

1. A photothermographic imageable material comprising an organic polymeric film base which is transparent within the visible region of the electromagnetic spectrum and absorbs ultraviolet radiation at a wavelength between 200 nm and 350 nm, each side of said film base having at least one photothermographic ultraviolet radiation sensitive layer thereon having spectral sensitivity within 20 nm of said wavelength between 200 nm and 350 nm, and said film base having an optical density of at least 0.3 where said at least one ultraviolet radiation sensitive layer is spectrally sensitive.

2. The imageable material of claim 1 wherein each side of said film base has a photosensitive layer thereon with the spectral sensitivity of the layer on both sides of said film base being within 5 nm of each other.

3. The imageable material of claim 1 wherein said ultraviolet radiation sensitive layers are photothermographic emulsion layers comprising photographic silver halide, a silver source material, reducing agent for silver ion, and a binder.

4. The imageable material of claim 2 wherein said ultraviolet radiation sensitive layers are photothermographic emulsion layers comprising photographic silver halide, a silver source material, reducing agent for silver ion, and a binder.

5. The imageable material of claim 1 within a film cassette, each major interior surface of said cassette having an X-ray converting screen adjacent to said ultraviolet radiation sensitive layers, both of said converting screens emitting radiation between 200 nm and 350 nm.

6. The imageable material of claim 2 within a film cassette, each major interior surface of said cassette having an X-ray converting screen adjacent to said ultraviolet radiation sensitive layers, both of said converting screens emitting radiation between 200 nm and 350 nm.

7. The imageable material of claim 3 within a film cassette, each major interior surface of said cassette having an X-ray converting screen adjacent to said ultraviolet radiation sensitive layers, both of said converting screens emitting radiation between 200 nm and 350 nm.

8. The imageable material of claim 4 within a film cassette, each major interior surface of said cassette having an X-ray converting screen adjacent to said ultraviolet radiation sensitive layers, both of said converting screens emitting radiation between 200 nm and 350 nm.

9. The imageable material of claim 1 wherein said film base has an optical density of at least 0.5 somewhere between 250 and 340 nm.

10. The imageable material of claim 2 wherein said film base has an optical density of at least 0.5 somewhere between 250 and 340 nm.

11. The imageable material of claim 3 wherein said film base has an optical density of at least 0.5 somewhere between 250 and 340 nm.

12. The imageable material of claim 4 wherein said film base has an optical density of at least 0.5 somewhere between 250 and 340 nm.

13. The imageable material of claim 5 wherein said film base has an optical density of at least 0.5 somewhere between 250 and 340 nm.

14. The imageable material of claim 6 wherein said film base has an optical density of at least 0.5 somewhere between 250 and 340 nm.

15. The imageable material of claim 7 wherein said film base has an optical density of at least 0.5 somewhere between 250 and 340 nm.

16. The imageable material of claim 8 wherein said film base has an optical density of at least 0.5 somewhere between 250 and 340 nm.

* * * * *

UNITED STATES PATENT AND TRADEMARK OFFICE

CERTIFICATE OF CORRECTION

PATENT NO. : 5,028,518

DATED : July 2, 1991

INVENTOR(S) : Thomas D. Lyons, Sergio Pesce and John M. Winslow

It is certified that error appears in the above-identified patent and that said Letters Patent is hereby corrected as shown below:

Column 5, line 36, "6.0 g toluene" should be --56.0 g toluene--.

Column 5, line 37, "0.0 g acetone" should read --10.0 g acetone--.

Signed and Sealed this

Twenty-sixth Day of October, 1993

*Attest:*

Bruce Lehman

BRUCE LEHMAN

*Attesting Officer*

*Commissioner of Patents and Trademarks*